US012018465B2

(12) United States Patent
Ruvang

(10) Patent No.: US 12,018,465 B2
(45) Date of Patent: Jun. 25, 2024

(54) HEEL SHROUD FOR MATERIAL MOVING IMPLEMENT AND ASSOCIATED METHODS

(71) Applicant: BLACK CAT WEAR PARTS, LTD., Edmonton (CA)

(72) Inventor: John A. Ruvang, Bartonville, TX (US)

(73) Assignee: BLACK CAT WEAR PARTS, LTD., Edmonton (CA)

( * ) Notice: Subject to any disclaimer, the term of this patent is extended or adjusted under 35 U.S.C. 154(b) by 310 days.

(21) Appl. No.: 17/177,964

(22) Filed: Feb. 17, 2021

(65) Prior Publication Data

US 2022/0259837 A1 Aug. 18, 2022

(51) Int. Cl.
*E02F 9/28* (2006.01)

(52) U.S. Cl.
CPC ..... *E02F 9/2883* (2013.01); *E02F 9/2833* (2013.01); *E02F 9/2858* (2013.01)

(58) Field of Classification Search
CPC ..... E02F 9/2883; E02F 9/2833; E02F 9/2858
See application file for complete search history.

(56) References Cited

U.S. PATENT DOCUMENTS 2,568,075 A * 9/1951 Launder ..... E02F 9/2841 37/457
4,550,512 A * 11/1985 Felstet ..... E02F 9/2808 172/753
4,716,666 A 1/1988 Potter
5,564,508 A * 10/1996 Renski ..... E02F 9/2883 37/456
5,913,605 A * 6/1999 Jusselin ..... E02F 9/28 403/380
6,041,529 A 3/2000 Ruvang
(Continued)

FOREIGN PATENT DOCUMENTS

AU 2010100656 A4 * 7/2010 ..... E02F 3/60
WO 2011156834 A1 12/2011
(Continued)

OTHER PUBLICATIONS

International Search Report with Written Opinion dated May 3, 2022 for PCT Patent Application No. PCT/US2022/011754, 12 pages.
(Continued)

*Primary Examiner* — Adam J Behrens
*Assistant Examiner* — Blake E Scoville
(74) *Attorney, Agent, or Firm* — Smith IP Services, P.C.

(57) ABSTRACT

A heel shroud can include a base with a leg having a profile formed thereon and another leg having a receptacle and at least one wear member receiving opening formed therein, a wear member with a leg having a profile formed therein for sliding engagement with the base profile and another leg having at least one inwardly facing projection formed thereon, a retainer opening formed in the projection, and a retainer member received in the receptacle and the retainer opening. A method can include sliding a leg of a wear member onto a leg of a base, thereby aligning a receptacle formed in another base leg with a retainer opening formed in a projection of another wear member leg, inserting a retainer member in the receptacle and the retainer opening, and installing a fastener in the retainer member, thereby preventing removal of the retainer member from the receptacle.

19 Claims, 8 Drawing Sheets

(56) References Cited

U.S. PATENT DOCUMENTS

| | | | | |
|---|---|---|---|---|
| 8,464,443 | B2 * | 6/2013 | Torgrimsen | E02F 3/40 37/444 |
| D788,182 | S | 5/2017 | Serrurier et al. | |
| 9,758,947 | B2 | 9/2017 | Serrurier et al. | |
| 2004/0216335 | A1 * | 11/2004 | Jones | E02F 9/2841 37/453 |
| 2005/0229442 | A1 * | 10/2005 | Jones | E02F 9/2883 37/452 |
| 2008/0092413 | A1 * | 4/2008 | McClanahan | E02F 9/2841 37/457 |
| 2013/0025171 | A1 * | 1/2013 | Torgrimsen | E02F 9/2883 37/444 |
| 2013/0145659 | A1 * | 6/2013 | LaHood | E02F 9/2883 37/453 |
| 2014/0173949 | A1 * | 6/2014 | Karlsson | E02F 9/2833 37/455 |
| 2016/0130791 | A1 * | 5/2016 | Serrurier | E02F 9/2883 37/450 |

FOREIGN PATENT DOCUMENTS

| | | | | |
|---|---|---|---|---|
| WO | WO-2012016251 | A1 * | 2/2012 | E02F 9/2825 |
| WO | 2012159155 | A1 | 11/2012 | |
| WO | WO-2012159155 | A1 * | 11/2012 | E02F 9/2825 |

OTHER PUBLICATIONS

Black Cat Wear Parts; "Corner, Lip & Heel Protection", company product article No. 920.0816, dated , 1 Page.

Futura Wear Technology; "High Performance Wear Parts", company product article via www.byg.com, dated Feb. 2012, 28 pages.

Futura; "Bucket Protection", company product article, dated Jan. 23, 2019, 18 pages.

The Bucket Shop; TBS Heel Shrouds, company product article via www.thebucketshop.ca, dated , 2 pages.

Hensley; "Weld-On Bucket Heel Shrouds", company product article, dated 2016, 2 pages.

* cited by examiner

HEEL SHROUD FOR MATERIAL MOVING IMPLEMENT AND ASSOCIATED METHODS

BACKGROUND

This disclosure relates generally to equipment utilized and operations performed in conjunction with excavation operations and, in an example described below, more particularly provides a heel shroud for a material-moving implement and associated methods.

A heel shroud is used to protect an exterior corner area of an implement (such as, a bucket, shovel or an earth moving implement) from wear. A heel shroud is "sacrificial," in that it is intended to wear, absorb impacts, etc., and then to be replaced, in order to protect the implement from such wear, impact, etc.

Therefore, it will be readily appreciated that improvements are continually needed in the arts of designing, constructing and utilizing heel shrouds for material-moving implements. It is among the objects of this disclosure to provide such improvements to the arts.

DETAILED DESCRIPTION

Figure 1:
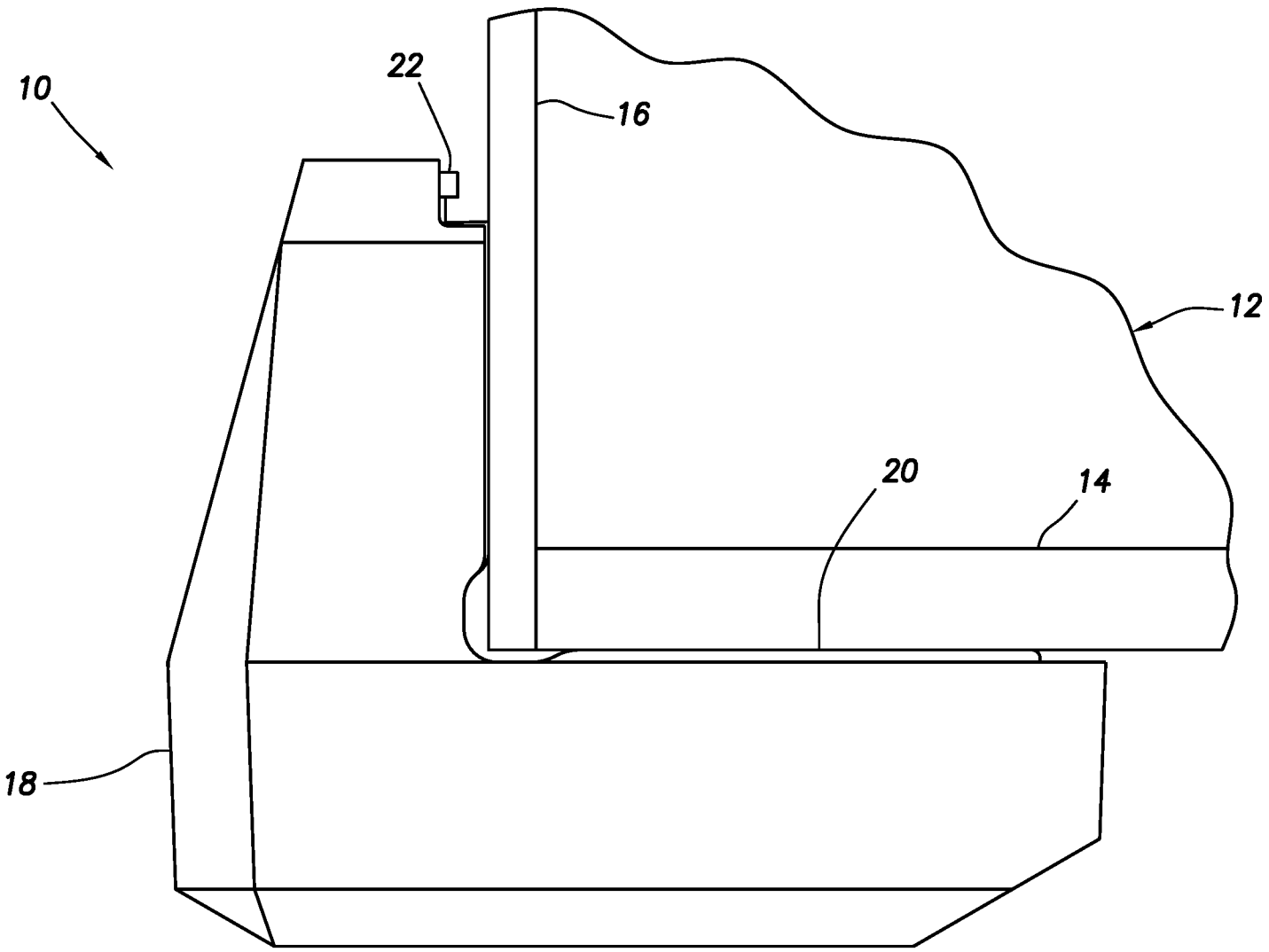
FIG. 1 is a representative partially cross-sectional view of an example of a heel shroud and associated method which can embody principles of this disclosure.

Representatively illustrated in FIG. 1 is a heel shroud 10 and associated method which can embody principles of this disclosure. However, it should be clearly understood that the heel shroud 10 and method are merely one example of an application of the principles of this disclosure in practice, and a wide variety of other examples are possible. Therefore, the scope of this disclosure is not limited at all to the details of the heel shroud 10 and method described herein and/or depicted in the drawings.

As depicted in FIG. 1, the heel shroud 10 is attached to an implement 12. The implement 12 may in various examples comprise a bucket, shovel, blade or other type of material-moving implement, which may be used in mining, construction, excavation, demolition, agriculture, loading or other operations. The scope of this disclosure is not limited to use of the heel shroud 10 on any particular type of material-moving implement.

In the FIG. 1 example, the implement 12 is a bucket having a lower plate 14 and a side plate 16. The heel shroud 10 is positioned at a corner or edge of the lower and side plates 14, 16 in order to protect the plates from impacts, wear or other damage in use of the implement 12. In practice, typically multiple heel shrouds 10 would be attached to the implement 12 along the corner or edge joining the lower and side plates 14, 16 on each side of the implement.

The heel shroud 10 includes a wear member 18 that is releasably secured to a base 20 by a retainer member 22. The wear member 18 is subjected to the impacts, wear or other damage that would otherwise be applied to the implement 12 in operation.

In this example, the wear member 18 can be conveniently replaced (such as, when it has been worn down or otherwise damaged) by removing the retainer member 22 and disengaging the wear member from the base 20. Another wear member can then be engaged with the base 20 and a retainer member 22 can be installed to thereby secure the wear member on the implement 12.

The base 20 is welded to the implement 12, for example, to the lower and side plates 14, 16. Thus, the base 20 is relatively permanently mounted to the implement 12. Of course, if the base 20 were to become damaged, it could be removed and replaced by cutting through the welds and then welding another base to the implement in its place.

In other examples, the base 20 could be releasably secured to the implement 12 (such as, using rivets, bolts, pins, etc.). The scope of this disclosure is not limited to any particular manner of permanently or releasably securing the base 20 to the implement 12.

Figure 2:
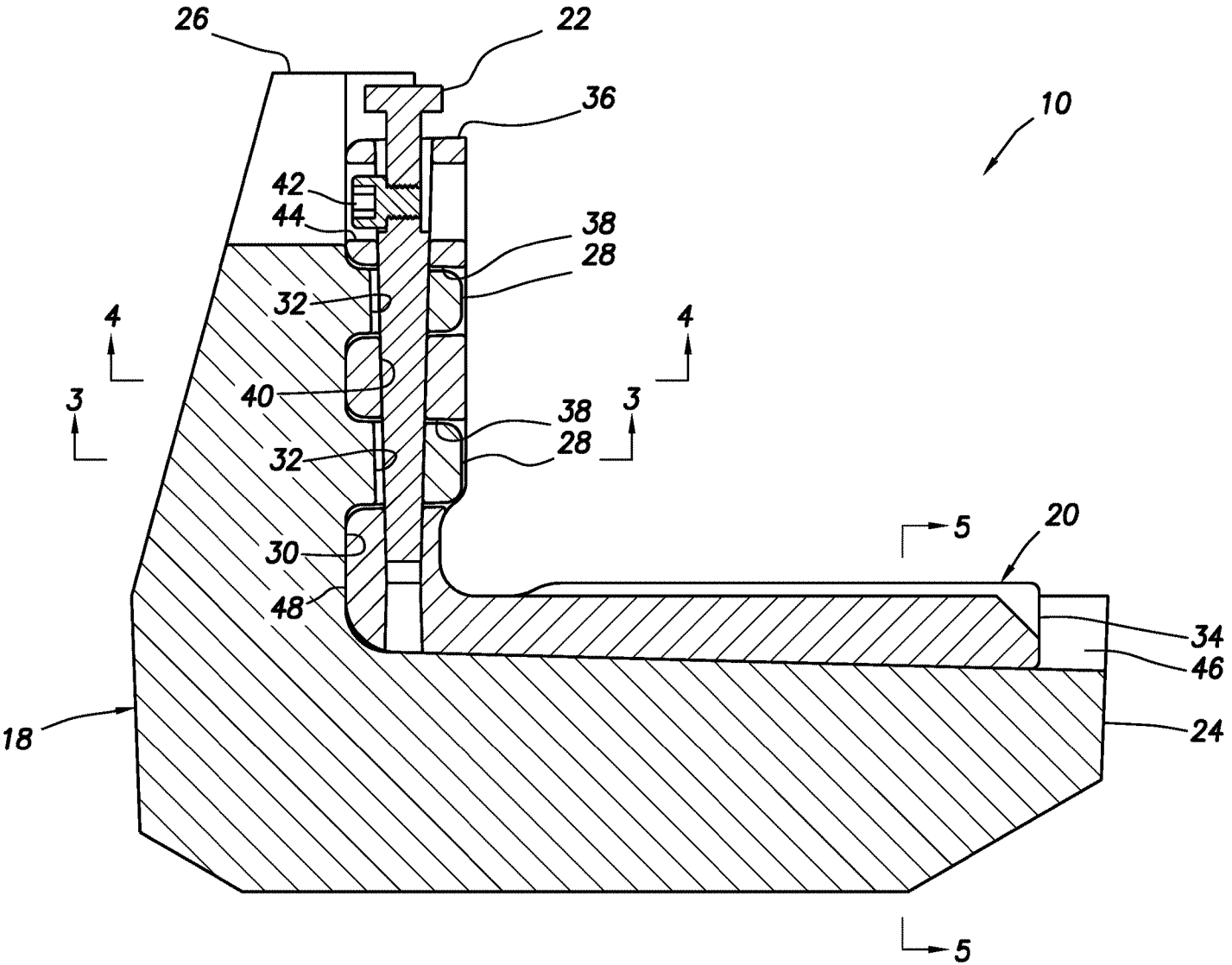
FIG. 2 is a representative cross-sectional view of the heel shroud.

Referring additionally now to FIG. 2, a cross-sectional view of the heel shroud 10 is representatively illustrated. In this view, the manner in which the wear member 18 is releasably secured to the base 20 using the retainer member 22 is clearly visible.

As depicted in FIG. 2, the wear member 18 includes a lower leg 24 and a side leg 26. The legs 24, 26 are oriented generally orthogonal to each other, for example, so that they conform to the orthogonal orientation of the implement lower plate 14 and side plate 16. In other examples, the legs 24, 26 may be otherwise oriented to conform to an implement having a different shape.

The side leg 26 includes multiple projections 28 extending inwardly (i.e., toward the implement side plate 16) from an abutment surface 30. Each of the projections 28 has a retainer opening 32 formed therein for receiving the retainer member 22.

The base 20 includes a lower leg 34 and a side leg 36. The lower and side legs 34, 36 are oriented orthogonal to each other in this example, similar to the wear member lower and side legs 24, 26. The base lower leg 34 is configured for sliding engagement with the wear member lower leg 24, and the base side leg 36 is configured for engagement with the wear member side leg 26.

The base side leg 36 includes multiple wear member receiving openings 38 configured to receive the respective projections 28 therein. In addition, a receptacle 40 is formed in the base side leg 36 for receiving the retainer member 22.

With the retainer member 22 inserted into the receptacle 40 and the retainer openings 32, the wear member 18 is releasably secured to the base 20. In this example, a fastener 42 (such as, a bolt, screw, pin, etc.) is threaded into the retainer member 22 to prevent the retainer member from being inadvertently dislodged from the side legs 26, 36. The fastener 42 is received in a fastener opening 44 formed in the base side leg 36.

The base lower leg 34 has a dovetail profile formed thereon (not visible in FIG. 2). The base dovetail profile is configured for sliding engagement with a complementarily-shaped dovetail profile 46 formed in the wear member lower leg 24.

In operation, the base 20 is secured to the implement 12 (see FIG. 1) as described above. The wear member 18 is then engaged with the base 20 by sliding the dovetail profiles of the lower legs 24, 34 together, until the projections 28 are received in the wear member receiving openings 38 and the abutment surface 30 is contacted by an abutment face 48 on the base side leg 36. This will substantially align the retainer openings 32 with the receptacle 40 in the base side leg 36. The retainer member 22 can then be installed in the retainer openings 32 and the receptacle 40, thereby securing the wear member 18 to the base 20. The fastener 42 is then installed to secure the retainer member 22.

Figure 4:
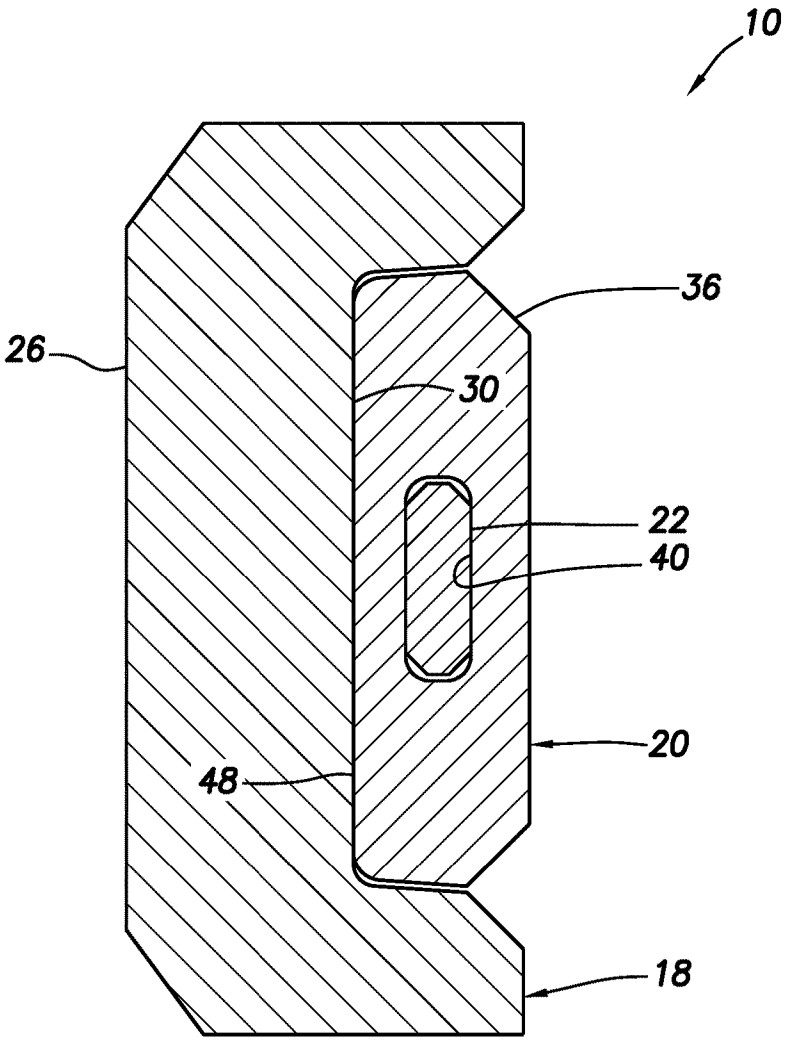
FIG. 4 is a representative cross-sectional view of the heel shroud, taken along line 4-4 of FIG. 2.
Figure 3:
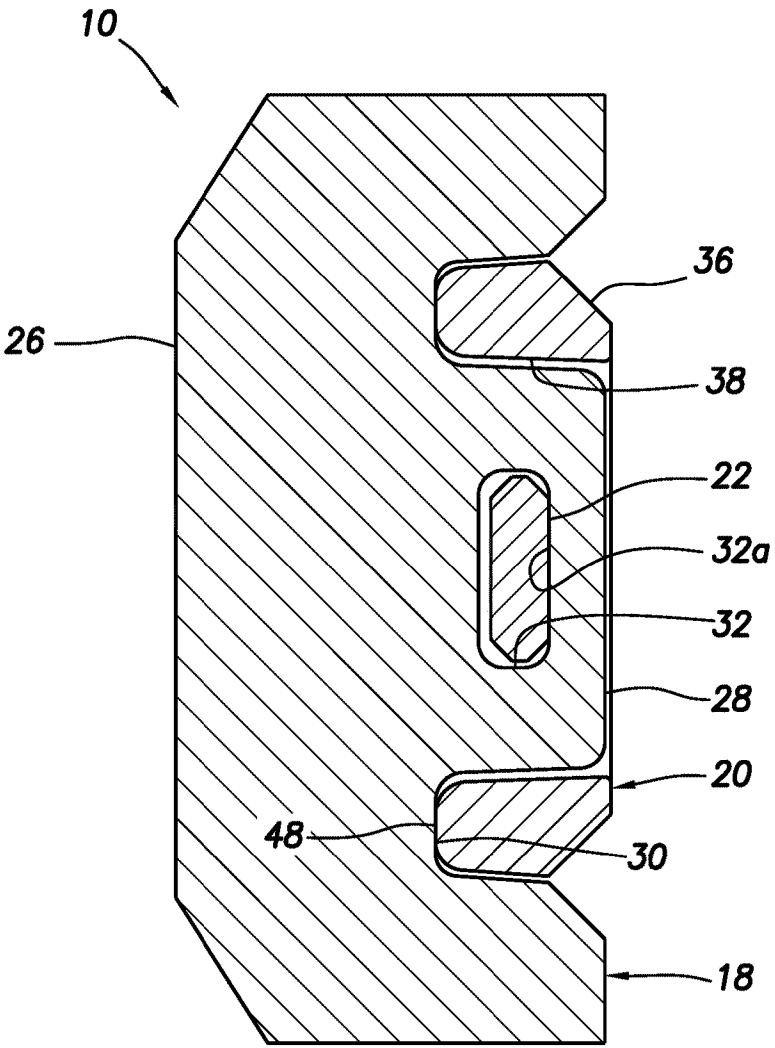
FIG. 3 is a representative cross-sectional view of the heel shroud, taken along line 3-3 of FIG. 2.

Referring additionally now to FIGS. 3 & 4, cross-sectional views of the heel shroud 10, taken along respective lines 3-3 and 4-4 of FIG. 2 are representatively illustrated. In these views, the manner in which the wear member 18 is releasably secured to the base 20 using the retainer member 22 is clearly visible.

In FIG. 3, it may be seen that one of the projections 28 is received in a respective one of the wear member receiving openings 38. The abutment surface 30 in the wear member side leg 26 contacts the base abutment face 48. The retainer member 22 is received in the retainer opening 32.

As described more fully below, the retainer member 22 has a wedge shape in this example, so that, as the retainer member is inserted downward into the retainer opening 32, an inclined surface on the retainer member engages an inclined outwardly facing surface 32*a* of the opening 32. This engagement between the retainer member 22 inclined surface and the surface 32*a* of the opening 32 biases the wear member side leg 26 inward (to the right as viewed in FIG. 3), so that the abutment surface 30 is increasingly biased against the abutment face 48.

In FIG. 4, it may be seen that the retainer member 22 is received in the receptacle 40 formed in the base side leg 36. In addition, there is a relatively large contact area between the abutment surface 30 and the abutment face 48, so that side loads are efficiently transmitted from the wear member 18 to the base 20, without substantial wear caused at the interface between them.

Figure 5:
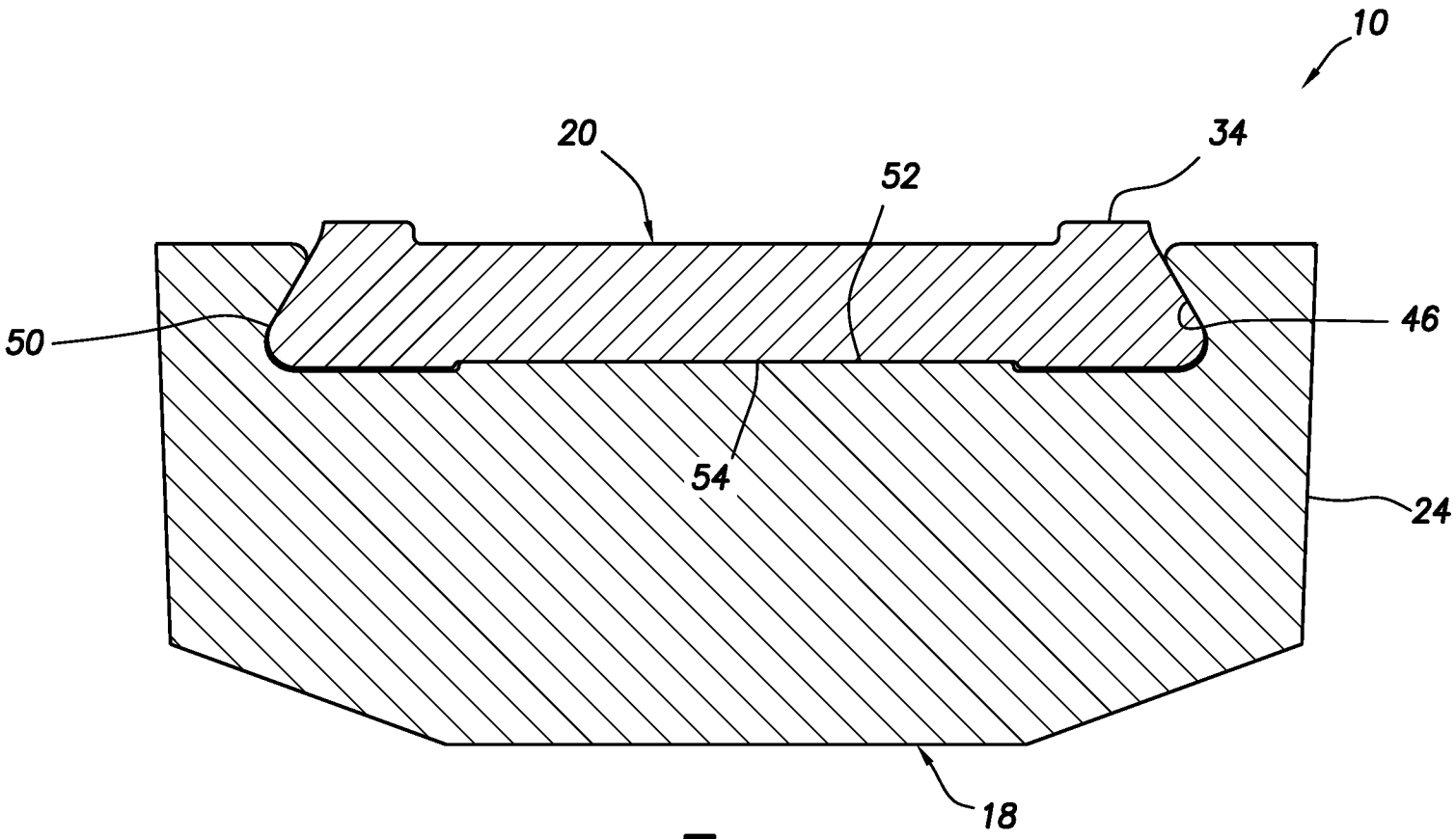
FIG. 5 is a representative cross-sectional view of the heel shroud, taken along line 5-5 of FIG. 2.

Referring additionally now to FIG. 5, another cross-sectional view of the heel shroud 10, taken along line 5-5 of FIG. 2, is representatively illustrated. In this view, the sliding engagement between the dovetail profiles 46, 50 formed on the respective wear member lower leg 24 and base lower leg 34 can be clearly seen.

With the dovetail profiles 46, 50 fully engaged, an abutment surface 52 formed on the wear member lower leg 24 contacts an abutment surface 54 formed on the base lower leg 34. A relatively large contact area between the abutment surfaces 52, 54 efficiently transmits loads from the wear member 18 to the base 20, without substantial wear caused at the interface between them.

As described more fully below, the dovetail profiles 46, 50 are angled, so that they converge toward one end. This facilitates separation of the dovetail profiles 46, 50 when the wear member 18 is removed in the presence of dirt and debris.

Figure 7:
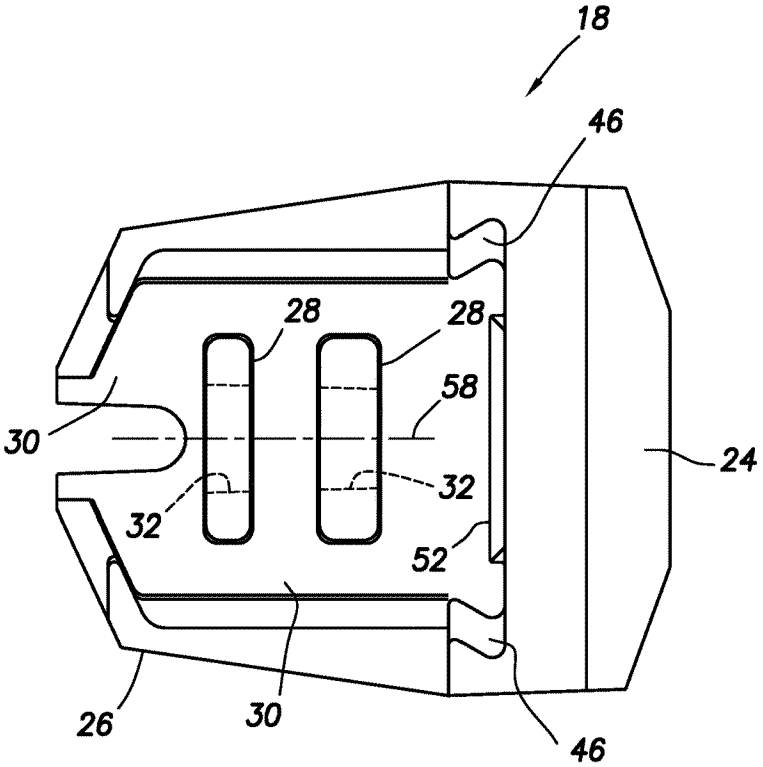
FIG. 7 is a representative side view of the wear member.
Figure 6:
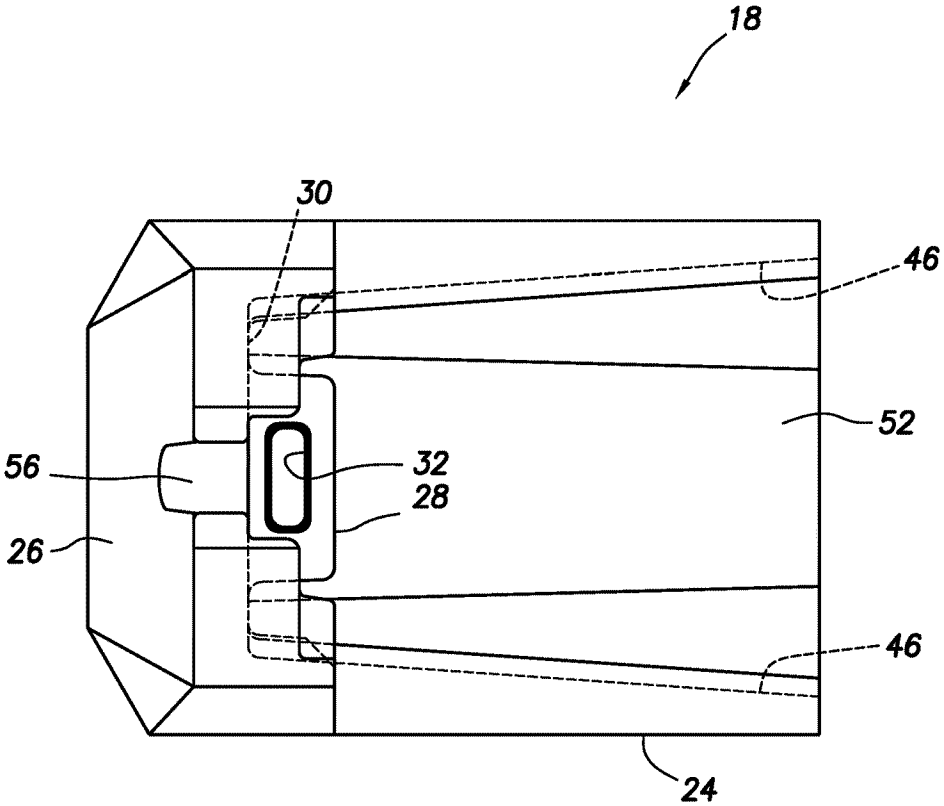
FIG. 6 is representative top view of a wear member of the heel shroud.

Referring additionally now to FIGS. 6 & 7, top and side views of an example of the wear member 18 are representatively illustrated. The wear member 18 is depicted apart from the remainder of the heel shroud 10 in FIGS. 6 & 7.

In FIG. 6, the manner in which the dovetail profile 46 converges toward the side leg 26 can be clearly seen. Note that the projections 28 extend inward (to the right as viewed in FIG. 6) from the abutment surface 30. A recess 56 is formed in the side leg 26 for installation of the fastener 42 in the retainer member 22 after the retainer member is received in the aligned openings 32 in the projections 28.

In FIG. 7, it may be seen that the openings 32 are aligned along an axis 58. The axis 58 is parallel to the abutment surface 30 and orthogonal to the dovetail profile 46.

Figure 9:
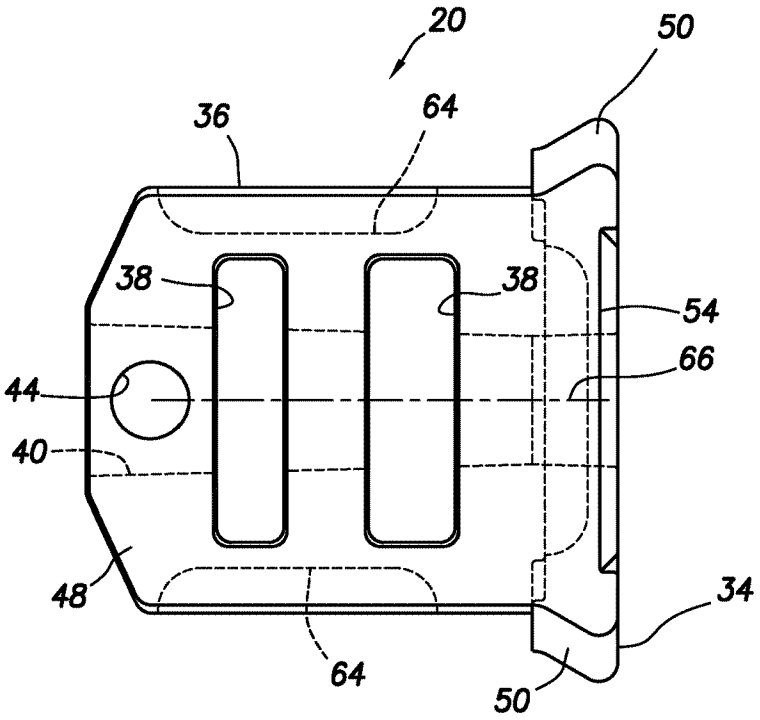
FIG. 9 is a representative side view of the base.
Figure 8:
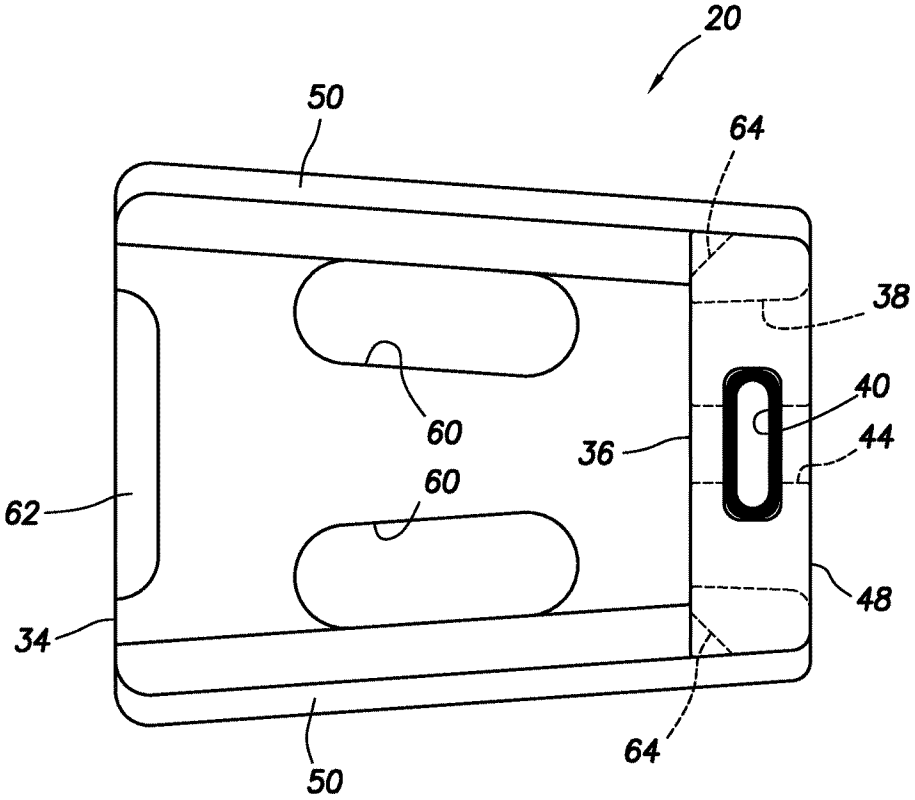
FIG. 8 is a representative top view of a base of the heel shroud.

Referring additionally now to FIGS. 8 & 9, respective top and side views of an example of the base 20 are representatively illustrated. The base 20 is depicted in FIGS. 8 & 9 apart from the remainder of the heel shroud 10.

In FIG. 8, the manner in which the dovetail profile 50 converges toward the side leg 36 can be seen. The lower leg 34 is provided with openings 60 and a bevel 62 for welding the base 20 to the lower plate 14 of the implement 12 (see FIG. 1). Bevels 64 are also formed in the side leg 36 for welding the base 20 to the side plate 16 of the implement 12.

In FIG. 9, it may be seen that the receptacle 40 extends along an axis 66. The axis 66 is parallel to the abutment face 48 and orthogonal to the dovetail profile 50.

Note that the receptacle 40 is tapered inward from a top of the side leg 36 toward the lower leg 34. This taper of the receptacle 40 matches that of inclined surfaces formed on the retainer member 22 as described more fully below.

Figure 10:
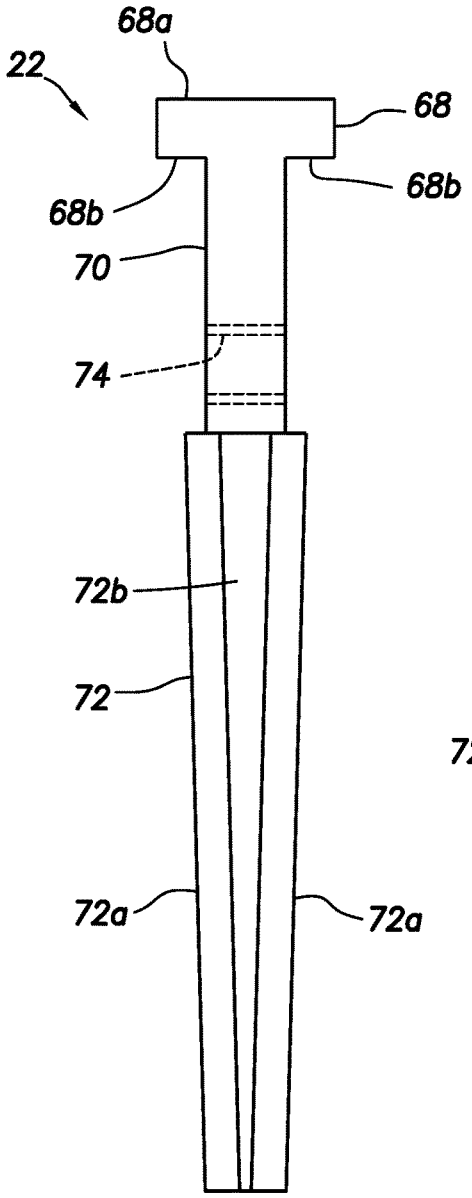
FIG. 10 is a representative side view of a retainer member of the heel shroud.
Figure 11:
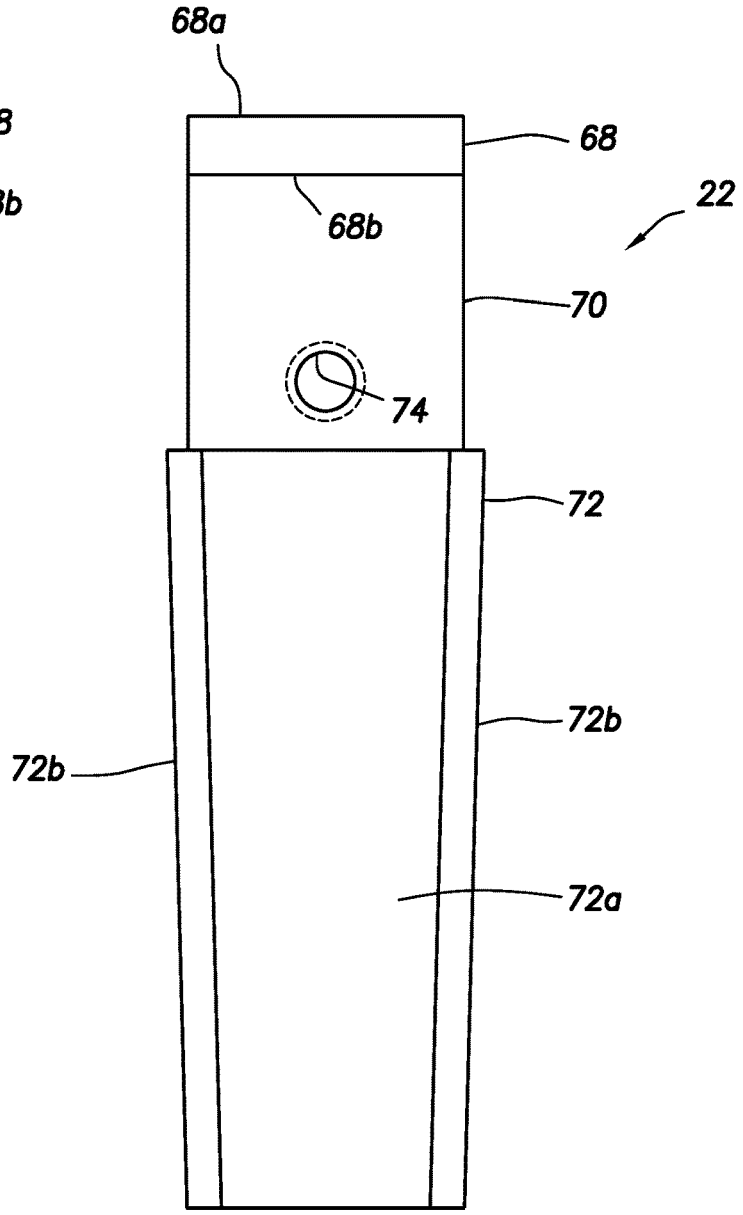
FIG. 11 is a representative front view of the retainer member.
Figure 12:
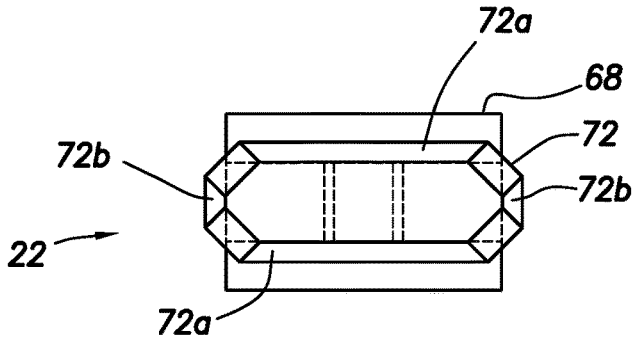
FIG. 12 is a representative bottom view of the retainer member.

Referring additionally now to FIGS. 10-12, respective side, front and bottom views of an example of the retainer member 22 are representatively illustrated. In this example, the retainer member 22 includes an upper head 68, an extension 70 and a tapered wedge-shaped body 72.

The head 68 is used in installation and removal of the retainer member 22. A top 68*a* of the head 68 may be used to push the retainer member 22 into the receptacle 40 and retainer openings 32 (see FIG. 2). Shoulders 68*b* may be used to pry the retainer member 22 out of the receptacle 40 and retainer openings 32.

The extension 70 has an internally threaded hole 74 formed therein. The fastener 42 (see FIG. 2) is threaded into the hole 74 in order to prevent the retainer member 22 from being dislodged from the heel shroud 10 in use.

The body 72 has inclined surfaces 72*a,b* formed thereon. The surfaces 72*a,b* converge toward a bottom end of the body 72. An interior of the receptacle 40 (see FIG. 9) is similarly tapered.

Figure 13:
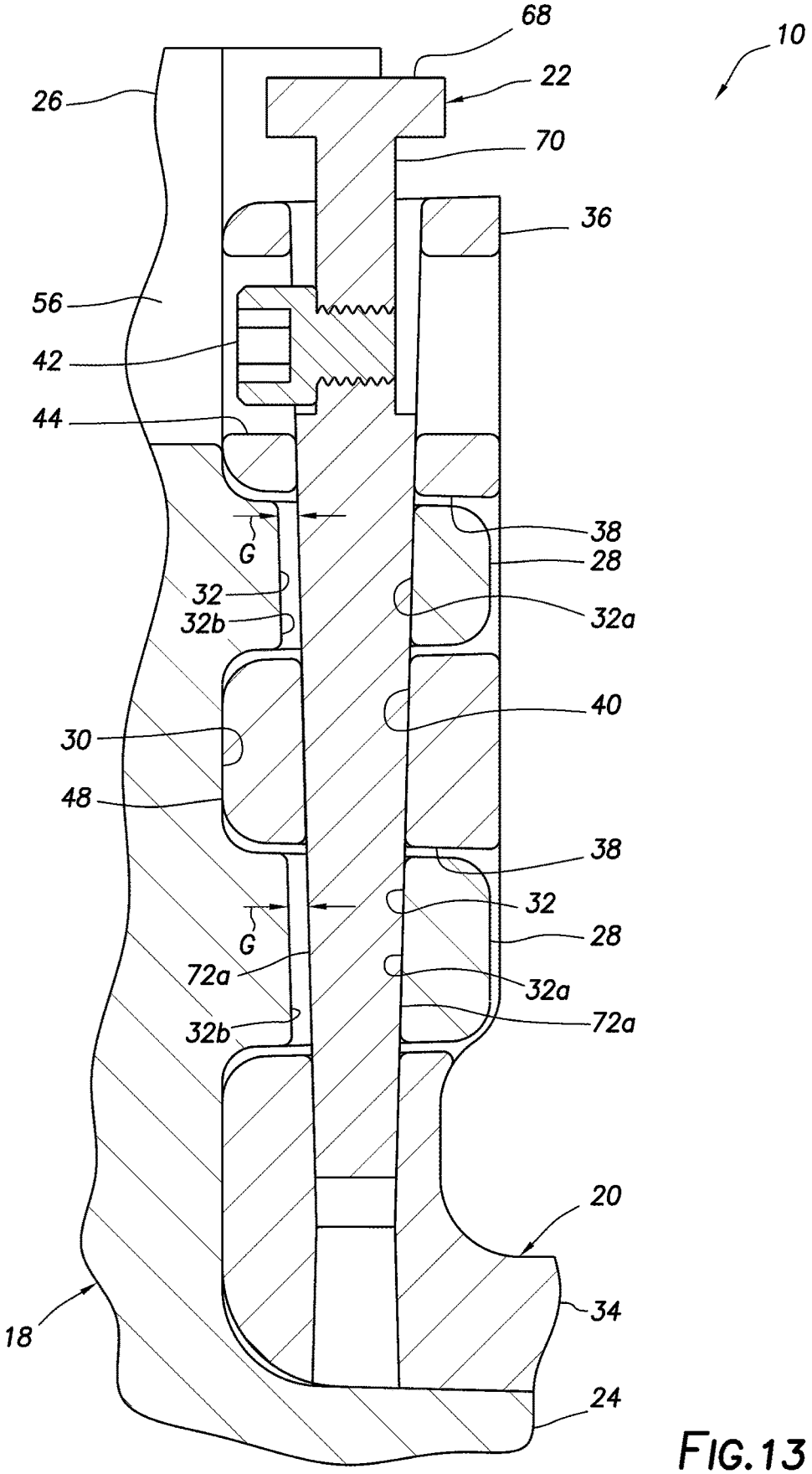
FIG. 13 is a representative cross-sectional view showing engagement of the retainer member in the wear member and base.

Referring additionally now to FIG. 13, a detailed cross-sectional view of the engagement between the retainer member 22 and each of the wear member 18 and the base 20 is representatively illustrated. In this view it can be seen that, when the retainer member 22 is fully installed in the receptacle 40, the inwardly facing inclined surfaces 72*a* on the body 72 engage outwardly facing surfaces 32*a* of the retainer openings 32. This engagement between the inclined surfaces 32*a*, 72*a* biases the wear member 18 inward (toward the implement side plate 16; see FIG. 1) and thereby biases the abutment surface 30 of the wear member against the abutment face 48 of the base 20.

A gap G is provided between the outwardly facing inclined surface 72*a* of the retainer member 22 and inwardly facing surfaces 32*b* of the retainer openings 32. The gaps G ensure that side loads applied to the wear member 18 are not transmitted to the retainer member 22.

It may now be fully appreciated that the above disclosure provides significant advancements to the arts of designing, constructing and utilizing heel shrouds for material-moving implements. In an example described above, the wear member 18 can be conveniently secured to and released from the base 20 by respective installation and removal of the retainer member 22, which is sured in the base by means of a fastener 42 received in an opening 44 in the base.

The above disclosure provides to the art a heel shroud 10 for use on a material-moving implement 12. In one example, the heel shroud 10 can include a wear member 18, a base 20 and a retainer member 22. The base 20 is configured to mount to the implement 12, the base 20 including first and second legs 34, 36. The base first leg 34 has a first profile 50 formed thereon, and the base second leg 36 has a receptacle 40 formed therein. The wear member 18 includes first and second legs 24, 26. The wear member first leg 24 has a second profile 46 formed therein configured for sliding engagement with the first profile 50. The wear member second leg 26 has at least one inwardly facing projection 28 formed thereon, and a retainer opening 32 formed in the projection 28. The retainer member 22 is received in the receptacle 40 and the retainer opening 32.

The base first leg 34 may be orthogonal to the base second leg 36. The receptacle 40 may be orthogonal to a wear member receiving opening 38 formed in the base second leg 36.

At least one wear member receiving opening 38 may be formed in the base second leg 36, and the projection 28 may be received in the wear member receiving opening 38.

The retainer member 22 may be wedge-shaped (e.g., the body 72 may have inclined surfaces 72*a,b* formed thereon).

The heel shroud 10 may include a fastener 42 secured to the retainer member 22 and received in a fastener opening 44 in the base second leg 36.

The base second leg 36 may include an outwardly facing abutment face 48, and the projection 28 may extend inward from an abutment surface 30 formed in the wear member second leg 26. The abutment face 48 may contact the abutment surface 30.

Displacement of the retainer member 22 into the receptacle 40 and the retainer opening 32 may bias the abutment face 48 against the abutment surface 30. Displacement of the retainer member 22 into the receptacle 40 and the retainer opening 32 may bias the retainer member 22 against an outwardly facing surface 32*a* of the retainer opening 32. The retainer member 22 may be spaced away from an inwardly facing surface 32*b* of the retainer opening 32.

A method of securing a heel shroud wear member 18 to a heel shroud base 20 on a material-moving implement 12 is also provided to the art by the above disclosure. In one example, the method can include: sliding a first leg 24 of the wear member 18 onto a first leg 34 of the base 20, thereby aligning a receptacle 40 formed in a second leg 36 of the base 20 with at least one retainer opening 32 formed in at least one projection 28 of a second leg 26 of the wear member 18; inserting a retainer member 22 in the receptacle 40 and the retainer opening 32; and installing a fastener 42 in the retainer member 22, thereby preventing removal of the retainer member 22 from the receptacle 40.

The sliding step may include receiving the projection 28 in a wear member receiving opening 38 formed in the base second leg 36.

The "at least one" projection 28 may include multiple projections 28. The sliding step may include receiving the projections 28 in respective multiple wear member receiving openings 38 formed in the base second leg 36.

The "at least one" retainer opening 32 may include multiple retainer openings 32. Each of the projections 28 may have a respective one of the retainer openings 32 formed therein. The inserting step may include inserting the retainer member 22 into each of the retainer openings 32.

The retainer member 22 may have at least one inclined surface 72*a* formed thereon. The inserting step may include the inclined surface 72*a* bearing against an outwardly facing surface 32*a* of the retainer opening 32.

The installing step may include threading the fastener 42 into the retainer member 22. The installing step may also include inserting the fastener 42 into a fastener opening 44 formed in the base second leg 36.

The base second leg 36 may include an outwardly facing abutment face 48. The projection 28 may extend inward from an abutment surface 30 formed in the wear member second leg 26. The inserting step may include biasing the abutment face 48 against the abutment surface 30.

The inserting step may include biasing the retainer member 22 against an outwardly facing surface 32*a* of the retainer opening 32. The inserting step may also include spacing the retainer member 22 away from an inwardly facing surface 32*b* of the retainer opening 32 (e.g., to provide the gap G).

Also described above is an example of a heel shroud wear member 18, comprising: a first leg 24 configured for sliding engagement with a heel shroud base 20, and a second leg 26 including at least one inwardly extending projection 28. At least one retainer opening 32 is formed in the projection 28, and the projection 28 is configured to be received in a wear member receiving opening 38 of the heel shroud base 20.

The retainer opening 32 may be oriented orthogonal to the first leg 24. The second leg 26 may be oriented orthogonal to the first leg 24.

The projection 28 may extend inwardly from an abutment surface 30 formed in the second leg 26. The abutment surface 30 may be configured to engage an abutment face 48 formed on the heel shroud base 20.

The "at least one" projection 28 may include multiple projections 28. The "at least one" retainer opening 32 may include multiple retainer openings 32. Each of the projections 28 may have a respective one of the retainer openings 32 formed therein. The retainer openings 32 may be axially aligned.

An outwardly facing surface 32*a* of the retainer opening 32 may be inclined and configured for engagement with an inclined surface 72*a* of a retainer member 22.

An internal profile 46 may be formed in the wear member first leg 24. The internal profile 46 may be a dovetail profile.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A heel shroud for use on a material-moving implement, the heel shroud comprising:

a base configured to mount to the implement, the base including first and second legs, the base first leg having a first profile formed thereon, and the base second leg having a receptacle formed therein and at least one wear member receiving opening which intersects the receptacle and divides the receptacle into first and second portions;

a wear member including first and second legs, the wear member first leg having a second profile formed therein configured for sliding engagement with the first profile, the wear member second leg having at least one inwardly facing projection formed thereon, and a retainer opening formed in the at least one projection; and a retainer member configured to be concurrently received in the retainer opening and in the first and second receptacle portions, whereby the wear member is secured to the base.

2. The heel shroud of claim 1, in which the base first leg is orthogonal to the base second leg.

3. The heel shroud of claim 1, in which the receptacle is orthogonal to a wear member receiving opening formed in the base second leg.

4. The heel shroud of claim 1, in which the projection is received in the wear member receiving opening.

5. The heel shroud of claim 1, in which the retainer member is wedge-shaped.

6. The heel shroud of claim 1, further comprising a fastener secured to the retainer member and received in a fastener opening in the base second leg.

7. The heel shroud of claim 1, in which the base second leg includes an outwardly facing abutment face, the projection extends inward from an abutment surface formed in the wear member second leg, and the abutment face contacts the abutment surface.

8. The heel shroud of claim 7, in which displacement of the retainer member into the receptacle and the retainer opening biases the abutment face against the abutment surface.

9. The heel shroud of claim 7, in which displacement of the retainer member into the receptacle and the retainer opening biases the retainer member against an outwardly facing surface of the retainer opening.

10. The heel shroud of claim 9, in which the retainer member is spaced away from an inwardly facing surface of the retainer opening.

11. A method of securing a heel shroud wear member to a heel shroud base on a material-moving implement, the method comprising:

sliding a first leg of the wear member onto a first leg of the base, thereby inserting at least one projection of a second leg of the wear member into a respective wear member receiving opening formed in a second leg of the base and aligning a receptacle formed in the second leg of the base with at least one retainer opening formed in the at least one projection;

inserting a retainer member in the at least one retainer opening and in the receptacle, in which the inserting comprises the retainer member concurrently extending through a first portion of the receptacle located above the at least one projection and through a second portion of the receptacle located below the at least one projection, thereby securing the wear member to the base; and installing a fastener in the retainer member, thereby securing the retainer member in the receptacle.

12. The method of claim 11, in which the at least one projection comprises multiple projections, and the sliding comprises receiving the projections in respective multiple wear member receiving openings formed in the base second leg.

13. The method of claim 12, in which the at least one retainer opening comprises multiple retainer openings, each of the projections has a respective one of the retainer openings formed therein, and the inserting comprises inserting the retainer member into each of the retainer openings.

14. The method of claim 11, in which the retainer member has at least one inclined surface formed thereon, and the inserting comprises the inclined surface bearing against an outwardly facing surface of the retainer opening.

15. The method of claim 11, in which the installing comprises threading the fastener into the retainer member.

16. The method of claim 15, in which the installing further comprises inserting the fastener into a fastener opening formed in the base second leg.

17. The method of claim 11, in which the base second leg includes an outwardly facing abutment face, the projection extends inward from an abutment surface formed in the wear member second leg, and the inserting comprises biasing the abutment face against the abutment surface.

18. The method of claim 17, in which the inserting comprises biasing the retainer member against an outwardly facing surface of the retainer opening.

19. The method of claim 18, in which the inserting further comprises spacing the retainer member away from an inwardly facing surface of the retainer opening.

* * * * *